US007530190B2

(12) United States Patent
Isayev et al.

(10) Patent No.: US 7,530,190 B2
(45) Date of Patent: May 12, 2009

(54) DISPLAY FRAME ADJUSTABLE DIVIDER

(75) Inventors: Igor Isayev, Berkley, MI (US); Evan C. Evans, Commerce, MI (US)

(73) Assignee: Marketing Displays, Inc., Farmington Hills, MI (US)

( * ) Notice: Subject to any disclaimer, the term of this patent is extended or adjusted under 35 U.S.C. 154(b) by 97 days.

(21) Appl. No.: 11/680,753

(22) Filed: Mar. 1, 2007

(65) Prior Publication Data

US 2007/0204501 A1 Sep. 6, 2007

Related U.S. Application Data

(60) Provisional application No. 60/778,154, filed on Mar. 1, 2006.

(51) Int. Cl.
*A47G 1/08* (2006.01)

(52) U.S. Cl. ..... 40/793; 40/741

(58) Field of Classification Search ..... 40/735, 40/739, 741, 742, 779, 782, 792, 793, 795, 40/794, 352, 357; 248/447
See application file for complete search history.

(56) References Cited

U.S. PATENT DOCUMENTS

| | | | | |
|---|---|---|---|---|
| 2,494,077 | A * | 1/1950 | Wilkinson | 355/40 |
| 2,790,259 | A * | 4/1957 | Havens | 40/741 |
| 3,298,124 | A * | 1/1967 | Jahn | 40/711 |
| 3,310,901 | A | 3/1967 | Sarkisian | |
| 3,514,886 | A * | 6/1970 | Drakard | 40/766 |
| 4,094,085 | A | 6/1978 | Nolan, Jr. | |
| 4,145,828 | A | 3/1979 | Hillstrom | |
| 4,460,116 | A * | 7/1984 | Bott | 224/321 |
| 4,958,458 | A * | 9/1990 | Hillstrom et al. | 40/793 |
| 5,307,575 | A * | 5/1994 | Ivansson et al. | 40/793 |
| 5,732,496 | A * | 3/1998 | Tanaka | 40/784 |
| 5,815,971 | A * | 10/1998 | Rothe et al. | 40/718 |
| 5,926,986 | A | 7/1999 | Dingle | |
| 5,930,928 | A * | 8/1999 | Kantola et al. | 40/793 |
| 6,233,859 | B1 | 5/2001 | Kilpatrick et al. | |
| 6,811,066 | B2 * | 11/2004 | Aftanas et al. | 224/321 |
| 2002/0066218 | A1 * | 6/2002 | Darby | 40/735 |

* cited by examiner

*Primary Examiner*—Gary C Hoge
(74) *Attorney, Agent, or Firm*—Harness, Dickey & Pierce, P.L.C.

(57) ABSTRACT

A display frame having a divider for subdividing the display area. The display frame includes a plurality of frame sections forming a rectangular perimeter around a backing member. A divider is selectively located within the display area and releasably secured by clamps on each end for subdividing the display area. The divider may be located in a horizontal, vertical or angular configuration. Alternately, the divider may be rotated substantially parallel with the frame section so as to be positioned in a stowed location.

17 Claims, 7 Drawing Sheets

FIG 8
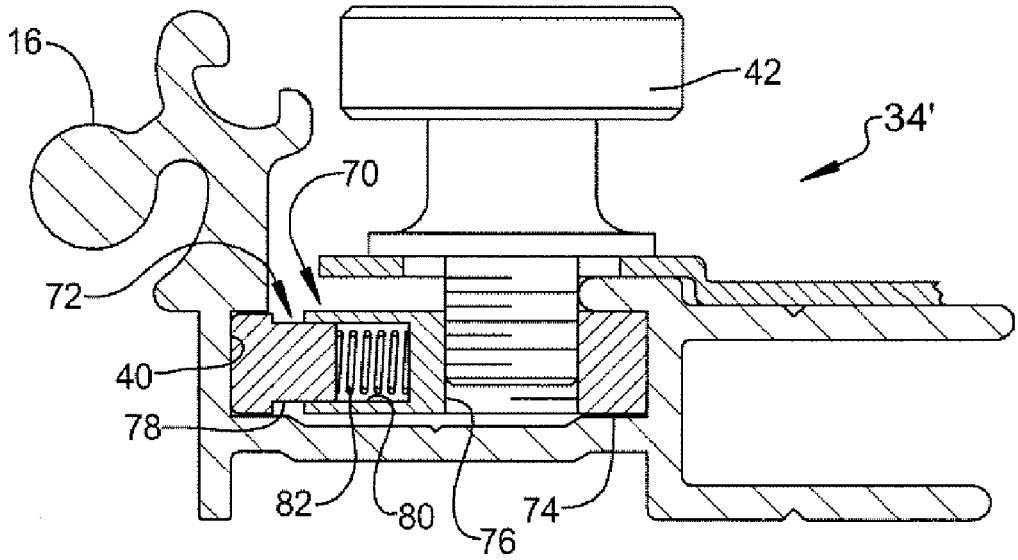
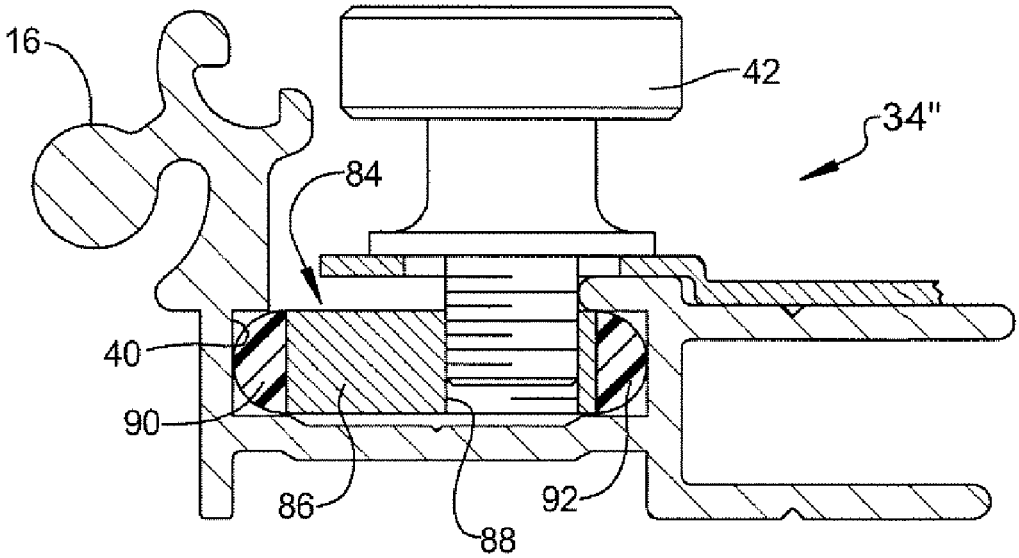
FIG 9

DISPLAY FRAME ADJUSTABLE DIVIDER

CROSS-REFERENCE TO RELATED APPLICATIONS

This application claims the benefit of U.S. Provisional Application No. 60/778,154, filed on Mar. 1, 2006. The disclosure of the above application is incorporated herein by reference.

FIELD

The present disclosure relates to a spring bias picture and poster frame, and more particularly to a moveable divider releasably secured to the poster frame.

BACKGROUND

The statements in this section merely provide background information related to the present disclosure and may not constitute prior art.

Known picture and poster frames include a plurality of frame sections, each frame section having a base member and a rotatable cover member attached to each base member. Spring biasing mechanisms are used to bias the cover member to the base member in its open and close position. Each frame section is mitered at 45° in the corner. Alternately, each frame section may be cut at 90° and secured together with a corner section. The frame is arranged in a generally rectangular configuration. Such frames may be made of an extruded metal such as aluminum or alternately of an extruded plastic such as polyvinyl chloride (pvc).

Once assembled, such frames are configured to provide a single display area suitable to securely positioning and displaying a single display medium such as an advertisement. In this regard, each of the frame sections is rotated into an open position and the display medium is inserted within the display frame. The frame sections are rotated into a closed position such that the display medium is secured within the frame. Poster frames of this type work very well and have secured substantial success in the marketplace.

However, in some applications, it is desirable to provide a frame, which may be readily adapted to display a plurality of display medium. For example, a frame capable of mounting a graphics portion and text portion would be advantageous to provide added versatility to the frame over those currently known in the art and added appeal to the media displayed therein.

SUMMARY

A display frame is disclosed and illustrated herein which provides a releasably securable divider that may be slidably positioned within a display area. The divider sub-divides the display area into multiple subsections adapted to support and display discrete display media. The display frame includes a plurality of frame sections forming a rectangular perimeter around a backing member. Each frame section has a base member and a rotatable cover member hingedly attached to each base member. A spring mechanism is interposed between the base member and cover member to bias the cover member in an open and closed position.

A divider mechanism is releasably secured to the frame section. Specifically, a clamp device having a moveable block and thumbscrew are inserted into a channel formed in the base member. The black may be disposed within the frame section prior to assembly of the display frame. Alternately, the block may include a retractable or compliant retainer that allows the block to be inserted into the frame section after assembly of the display frame. The thumbscrew may be tightened and loosened for securing the clamp in a desired location within the channel formed in the frame section. Each end of the divider is coupled to a corresponding clamp such that the divider extends across a portion of the display window for subdividing the display area. By loosening each clamp, the divider may be selectively positioned within the display area to provide a horizontal subdivision, vertical subdivision, or angular subdivision of the display area. Preferably, the divider has an aperture formed in one end thereof for pivotally coupling the divider to a clamp, and a slot formed in the opposite end to loosely secure the divider to another clamp. In this manner, the opposite end of the divider may be uncoupled from its corresponding clamp such that the divider may then be rotated into a position parallel to the corresponding frame section such that the divider can be stowed beneath the cover member should it be desirable to provide an undivided display area.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

Figure 2:
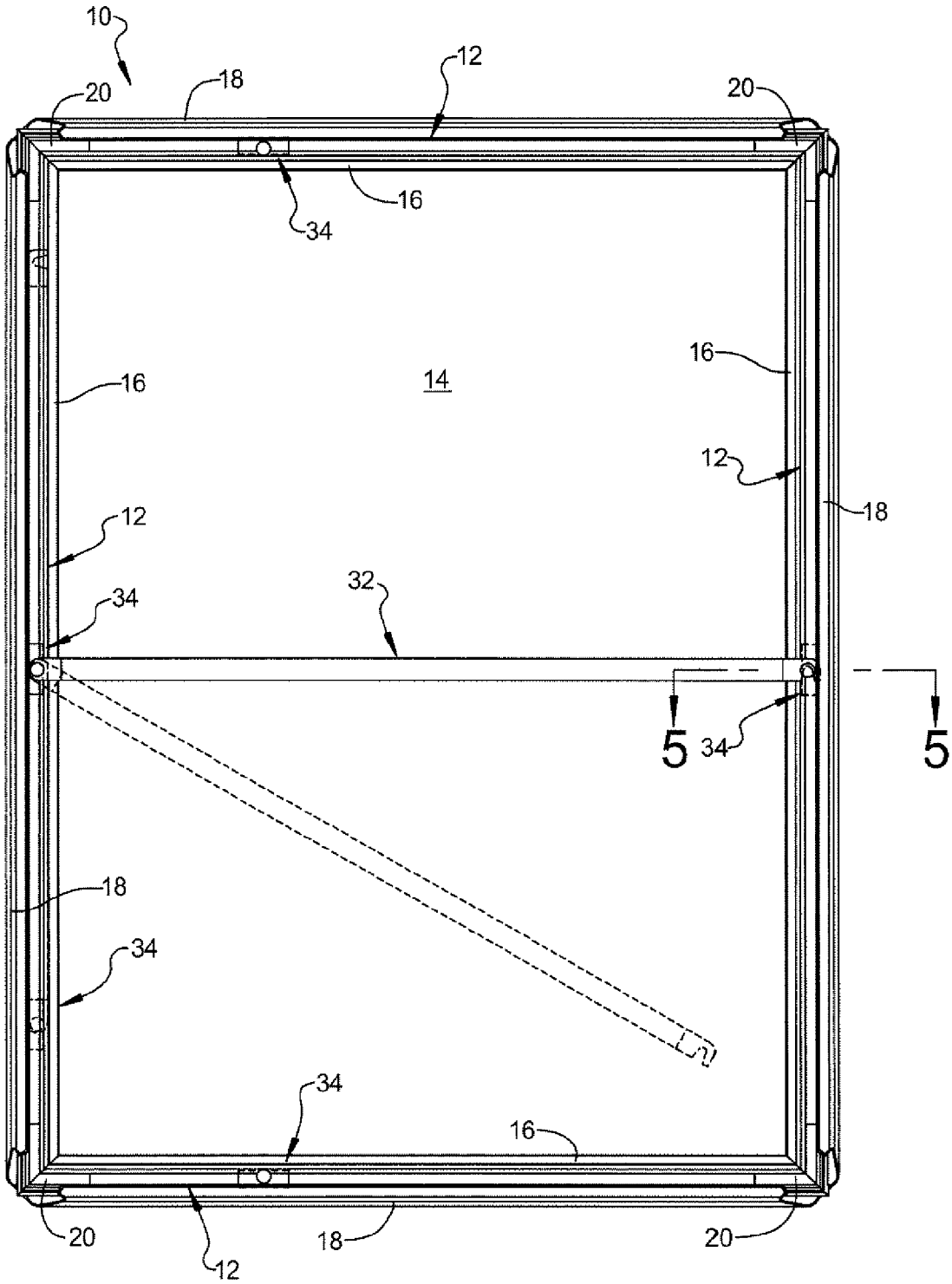
FIG. 2 is a front view similar to FIG. 1 with the cover members rotated into an open position.
Figure 6:
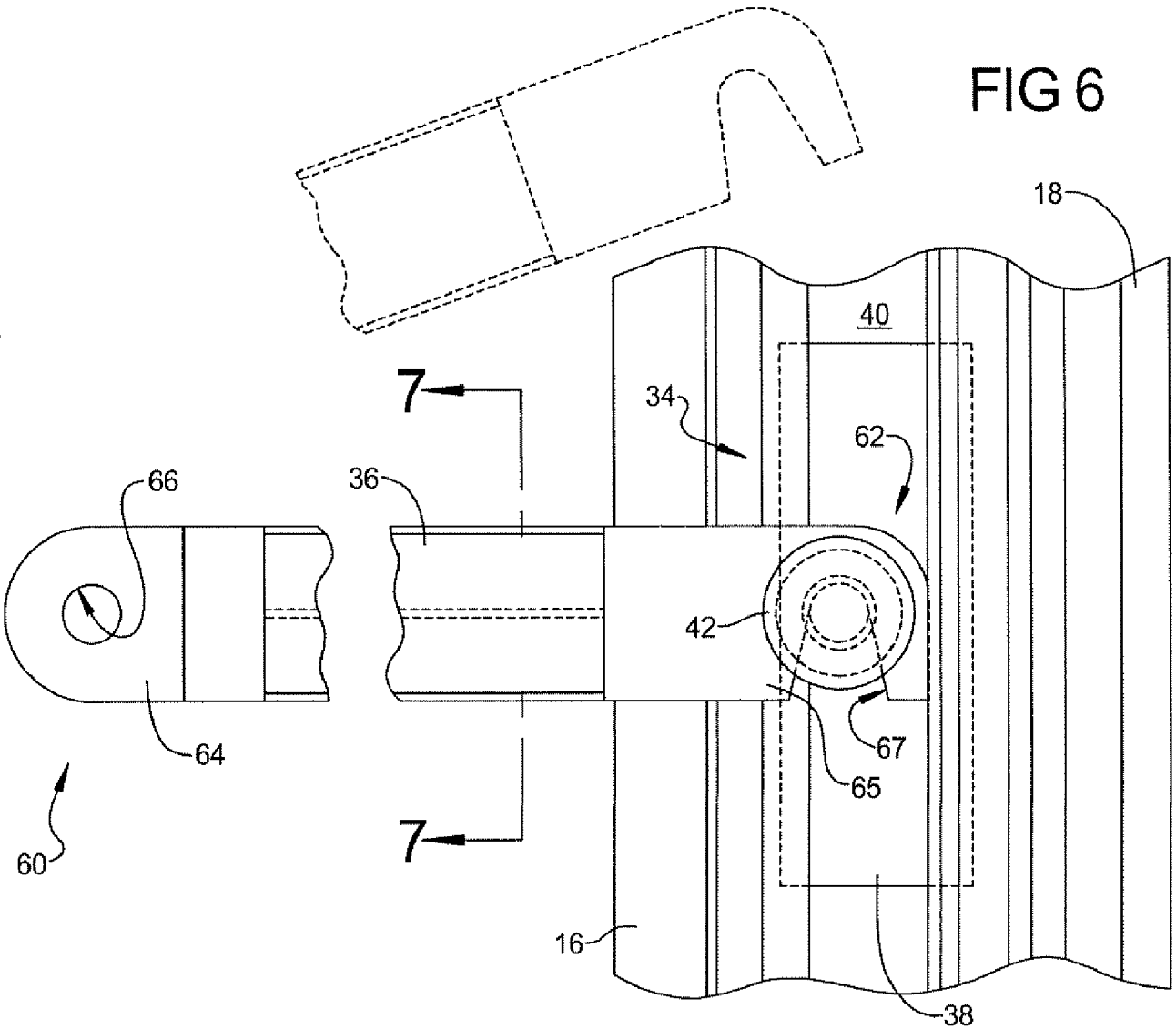
FIG. 6 is a detail illustrating the clamp and configuration of the exemplary divider.
Figure 7:
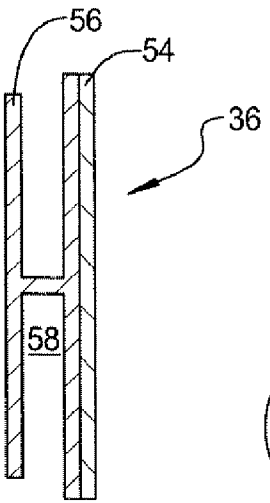

FIG. 7 is a cross-section of the exemplary divider taken along line 7-7 shown in FIG. 6; and FIG. 8 is a cross-section taken along line 5-5 shown in FIG. 2 illustrating a second embodiment of a clamp mechanism described herein; and FIG. 9 is a cross-section taken along line 5-5 shown in FIG. 2 illustrating a third embodiment of a clamp mechanism described herein.

DETAILED DESCRIPTION

The following description is merely exemplary in nature and is not intended to limit the present disclosure, application, or uses.

With reference now to the drawings, the display frame 10 includes a plurality of frame sections 12. Specifically, frame 10 is rectangular in shape and has four frame sections 12 forming its periphery. The frame section 12 surrounds a backing member 14, which is used to support a display media typically containing a picture, or graphics portion A and a text portion B. However, it should be appreciated that each portion A, B of the display media may be of either graphic or textural material.

Each of the frame sections 12 includes a base member 16 and a cover member 18 pivotally coupled to each other. Each frame section 12 is cut to a desired length and mitered 45 degrees at opposite ends for abutting and co-planar assembly with one another to outline the frame 10. As presently preferred, frame 10 is configured in a square or rectangular shape, although it is also possible for the frame to have any desired polygonal shape with an appropriate number of sections 12 mitered at appropriate angles. Each of the base members 16 and cover members 18 may be fabricated utilizing a suitable material and process. As presently preferred, these members 16 and 18 are formed using metal or plastic extruding processes. Backing member 14 is preferably a hollow core board having a pair of planar surfaces interconnected with internal webs; however, other suitable materials are available.

Adjacent frame sections 12 of frame 10 are held and fastened together by L-shaped corner braces 20. The corner braces 20 are positioned in a channel formed in each of the base members 16 and secured in place by fasteners (not shown) such as screws or pop rivets.

Figure 3:
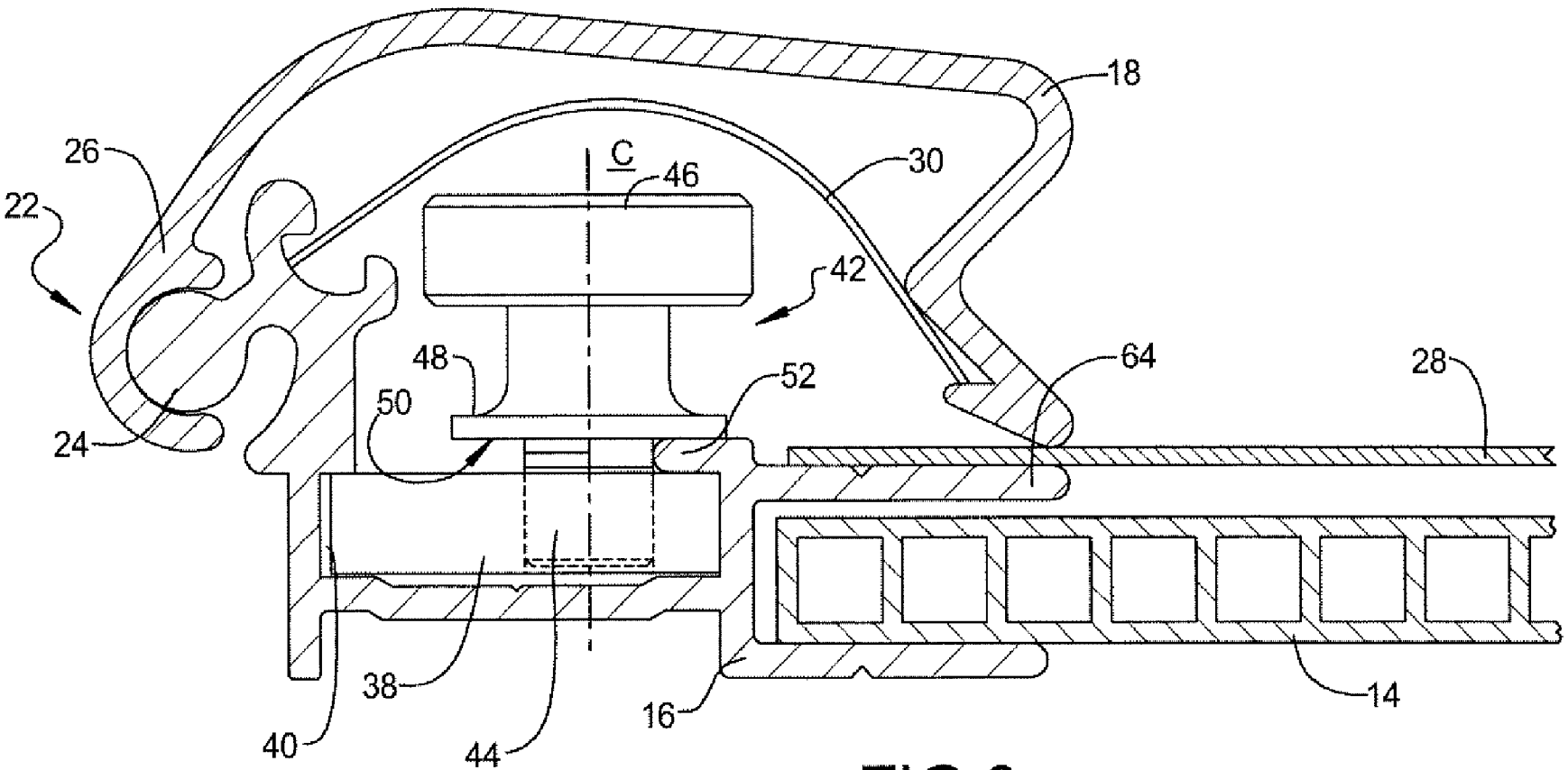
FIG. 3 is a cross-section taken along line 3-3 as shown in FIG. 1.
Figure 4:
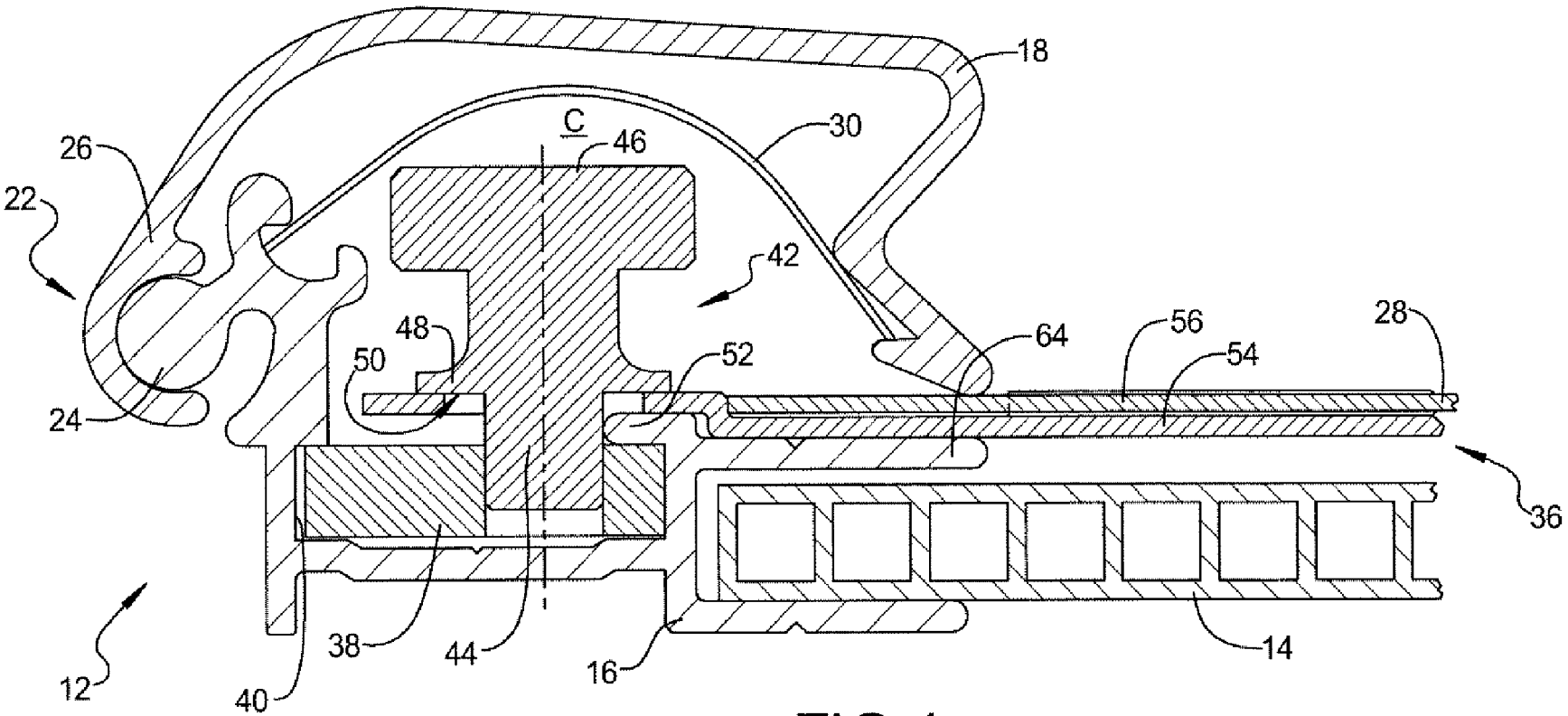
FIG. 4 is a cross-section taken along line 4-4 shown in FIG. 1.

Cover member 18 of each frame section 12 is assembled to base member 16 by means of hinge mechanism 22 which includes a cylindrical hinge or pivot pintle 24 extending outwardly from the base member 16 and a corresponding hinge channel 26 formed on the cover member 18. The edges of hinge channel 16 extend slightly more than 180 degrees around pintle 24 such that the hinge mechanism 22 may be slidably assembled in a longitudinal direction or snapped together. The hinge mechanism 22 allows the cover member 18 to pivot relative to the base member 16. When in the closed position as shown in FIGS. 3 and 4, the cover member 18 holds the display medium 28 securely in position within the frame 10. When it is desired to remove or replace the display media 28, the cover member 18 is rotated or pivoted to an open position shown in FIG. 5, thereby permitting removal of the display medium 28.

Figure 5:
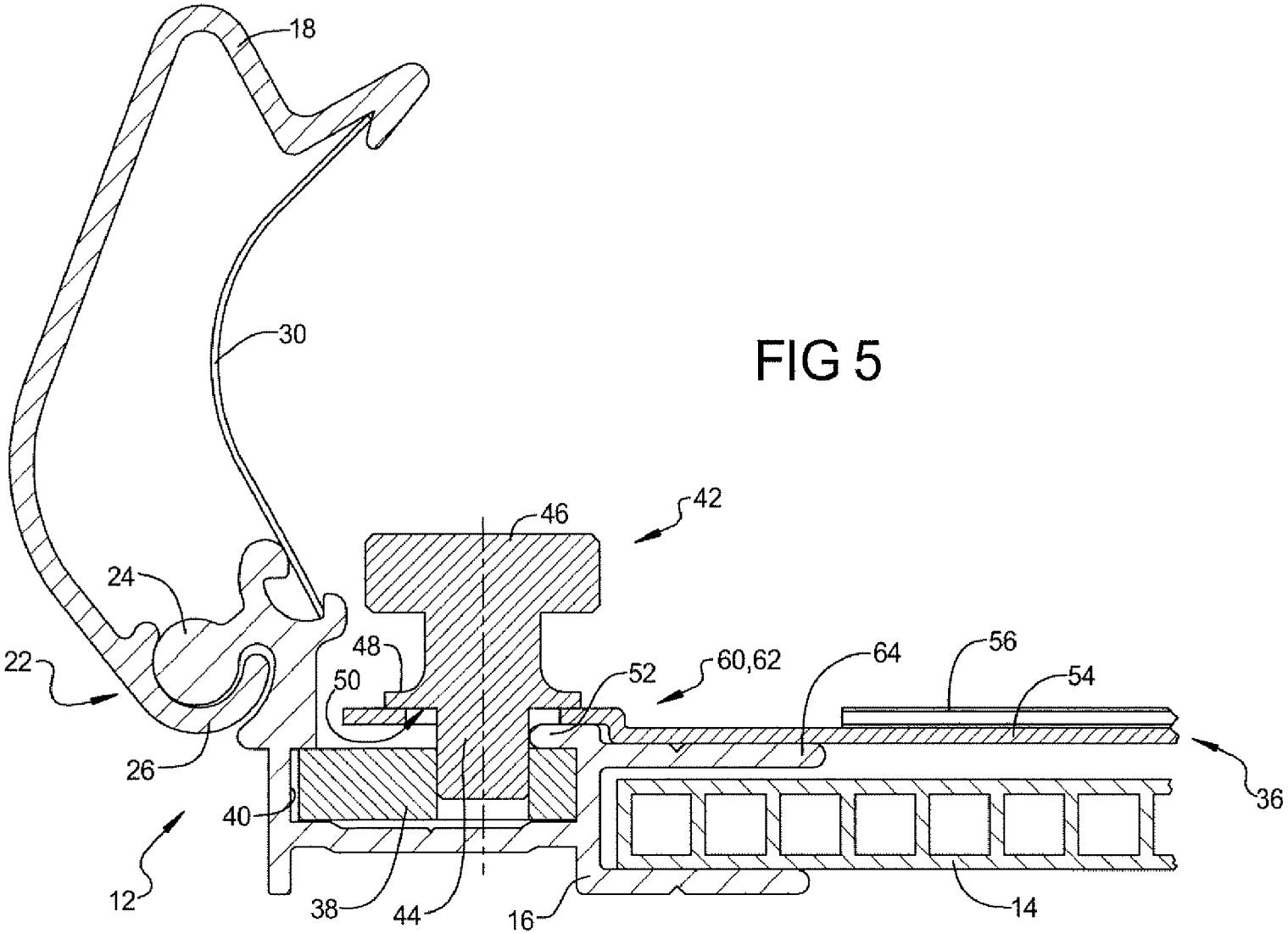
FIG. 5 is a cross-section taken along line 5-5 shown in FIG. 2.

One or more spring members 30 are positioned in each of the frame sections 12 extending between the base member 16 and the cover member 18. The spring member 30 biases the two members 16, 18 relative to one another. The spring member 30 acts to maintain a snug mating pivotal engagement, biasing the cover member 18 against the display medium 28 when the frame members 12 are in the closed position and holding the cover members 18 in open upright position (as shown in FIG. 5) for removal or replacement of the display medium. Spring members 30 are preferably made of a spring steel or stainless steel having a flat, square or rectangular shape. The spring members 30 are adapted to be flexed or bowed when the cover member 18 is rotated and provides the desired cantilever snap action for biasing the frame sections 12.

Frame 10 further includes a divider mechanism 32 coupled to the frame sections 12 and positionable to subdivide the display area defined thereby. The divider mechanism 32 includes a clamp 34 slidably supported within each of the base members 16 and a divider 36 adapted to extend across the display area. It should be appreciated that divider mechanism 32 may include a clamp 34 which can be retrofit into other existing frame sections, such as those described by U.S. Pat. No. 3,310,901 to Sarkisian, U.S. Pat. No. 4,145,828 to Hillstrom and U.S. Pat. No. 5,926,986 to Dingle.

As best seen in FIG. 3-5, the clamp 34 includes a slide block 38 received within a channel 40 formed in the base member 16 and slidably positionable along the length of frame section 12. As presently preferred, channel 40 is adapted to receive the corner member 20 as heretofore described.

Clamp 34 further includes a fastener 42 threadingly engaging block 38. As presently preferred, fastener 42 is a thumb screw having a threaded shank 44 extending into block 38, an enlarged head portion 46 formed on an opposite end to facilitate manipulation (i.e., loosening and tightening) of the fastener 42 and a shoulder portion 48 providing a clamping face 50. As best seen in FIG. 3, the shoulder portion 48 extends outwardly from the threaded portion 44, a distance sufficient to capture flange 52 formed on base member 16. In this manner, flange 52 is captured between block 38 and clamping face 50. Thus, clamp 34 may be fixedly positioned within channel 40 by tightening fastener 42 causing flange 52 to be clamped between block 38 and clamping face 50. It will be noted that when clamp 34 is in a clamped positioned, the end of threaded portion 44 does not extend beyond block 38 into channel 40. It will also be noted that when cover member 18 is in the closed position, fastener 42 is aligned beneath the cover member 18 in cavity C. While a thumb screw is presently preferred, it should be appreciated that clamp 34 may utilize other threaded fasteners which provide the clamping function herein described.

It should also be appreciated that clamp 34 may include alternate means for slidably positioning and releasably securing divider 36 along frame section 12. As shown in FIG. 8, clamp 34' may include a slider block 70 which further includes a retractable retainer mechanism 72 that allows the slider block 70 to be positioned in channel 40 without disassembling the display frame 10. Slider block 70 includes a body 74 having a threaded aperture 76 to receive fastener 42. A retractable pin 78 is received and slidably supported within a blind bore 80 formed in body 74. A spring 82 is disposed in blind bore 80 and biases pin 78 laterally outward. The width of body 74 is such that it can be inserted into channel 40 when pin 78 is compressed into blind bore 80. Once slider block 72 is properly positioned within channel 40, pin 78 is released and slider block 72 is captured within the channel 40.

With reference to FIG. 9, another alternate embodiment of clamp 34" is shown. Slider block 84 includes a body portion 86 having a threaded aperture 88 to provide a threaded metal interface between block 84 and fastener 42. The lateral portions 90, 92 of slider block 84 are fabricated from a slightly compliant material such as a plastic urethane which allows them to be compressed so that slider block 84 can be inserted into channel 40. While slider block 84 is shown as having a pair of compliant lateral portions 90, 92, a single compliant lateral portion 90 could be used by adjusting the dimension of the body portion 86. Once slider block 84 is properly positioned within channel 40, lateral portions 90, 92 relax and slider block 84 is captured within channel 40.

With reference again to FIG. 4-7, divider 36 includes a substrate or support 54 having an H-shaped channel member 56 secured thereto. While divider 36 is shown as a two-part assembly having a support 54 and a channel member 56, it should be appreciated that these components may be integrated into a single element. The H-shaped channel member 56 provides a recessed area 58 for capturing an edge of the display media. For example, the lower edge of picture medium A and the upper edge of text medium B illustrated in FIG. 1. A stepped end 60, 62 is provided at each end of divider 36. The stepped end 60, 62 is formed therein such that substrate 54 is located in abutting engagement with flange, 65 which is offset from flange 52. As illustrated in FIG. 6, stepped end 60 has an aperture 66 formed therethrough to receive threaded portion 44 of fastener 42. In this manner, divider 36 and a particular stepped end portion 60 may be pivotally coupled to clamp 34 by fastener 42. The opposite stepped end 62 is provided with a downwardly facing slot 67 sized to received the threaded portion 44 of fastener 42. In this manner, the stepped end 62 of the divider 36 may be readily uncoupled from clamp 34

Figure 1:
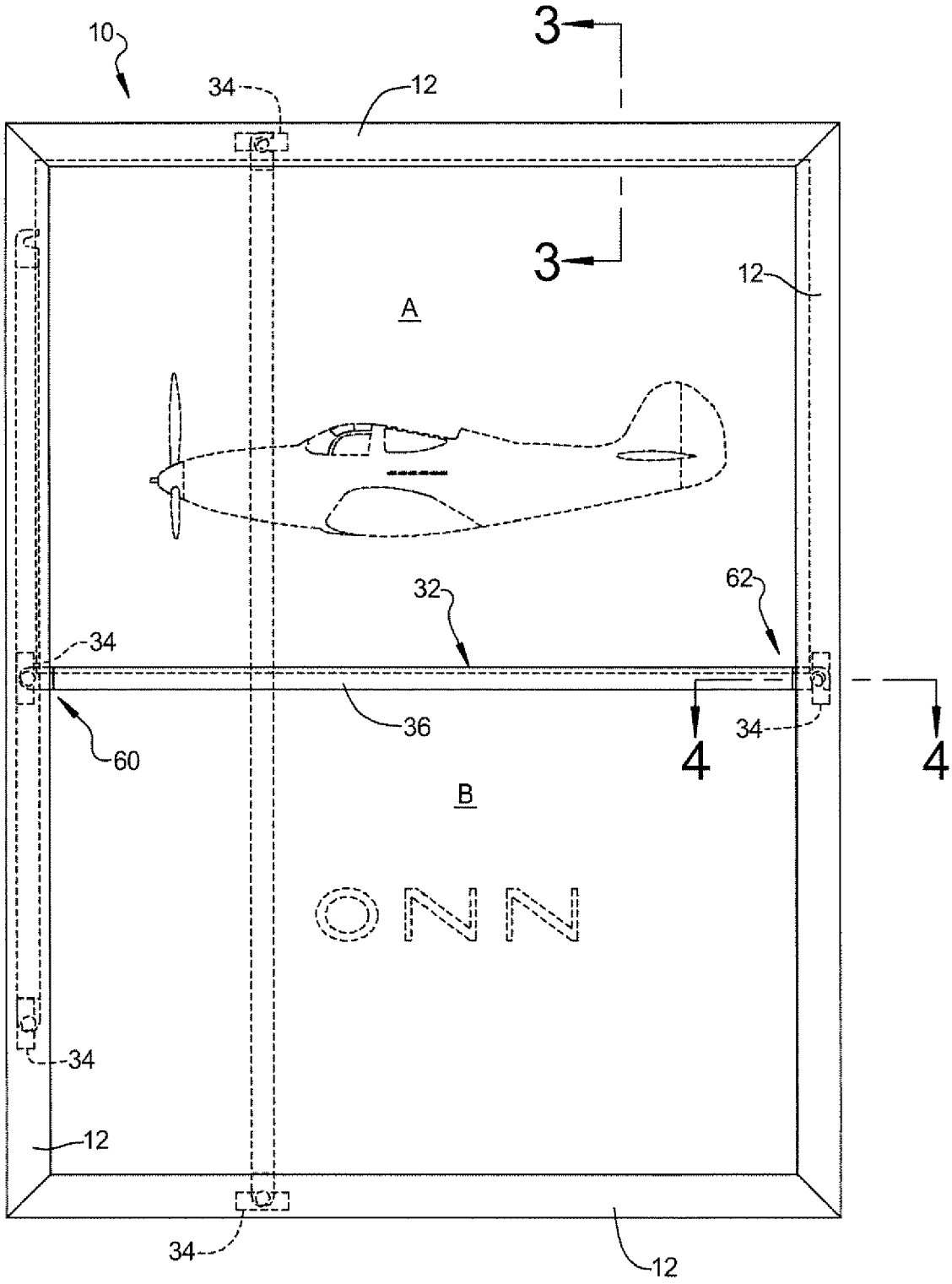
FIG. 1 illustrates a front view of the exemplary display frame described herein with the cover members rotated into a closed position.

The display frame 10 described and illustrated herein provides a divider 36 which may be selectively positioned to subdivide the display area, or alternately move to a stowed position within one of the frame sections 12. More specifically, clamp members 34 are loosened and selectively positioned within channel 40 of frame sections 12 at a desired location for subdividing the display area. As can be seen in FIG. 1, subdivision of the display area is preferably in a horizontal manner (as shown in solid lines) or in a vertical manner (as shown in dash lines). However, it will be appreciated that the divider mechanism 36 described herein allows infinite adaptability for subdividing the display area. Once the clamps 34 are positioned in the desired location the divider 36 is pivoted into engagement with clamps 34 which are then tightened to securely locate the divider 36 within the display area.

The display area may be reconfigured by loosening the clamp members 34 and repositioning the divider 36 into a new location. Alternately, the divider 36 may be positioned into a stowed location within frame member 12. In this manner, clamp 34 is loosened and slid towards one end of the frame section 12. The divider 36 is rotated to a position parallel to the frame section 12. The clamp member 34 is then tightened such that the divider 36 may be securely stowed within channel 40 formed in base member 16.

It should be appreciated that the display frame described herein provides a divider which may be selectively positioned to subdivide the display area affording flexibility with the display media to be secured and displayed therein. While specific embodiments have been illustrated and described, it should be understood that these embodiments are provided by way of example only and that the present invention is not to be construed as being limited thereto, but only by the scope of the following claims.

What is claimed is:

1. A display frame having a divided display area comprising:

a plurality of frame sections forming a rectangular perimeter around a backing member to define a display area, each of said plurality of frame sections having a base member and a rotatable cover member hingedly attached to said base member;

a plurality of clamps associated with said plurality of frame sections, each of said plurality of clamps including a block inserted and slidably positioned within a channel formed in said base member and a fastener threadingly engaging said block such that a flange formed on said base member is clamped therebetween for securing said clamp in a desired location within said channel formed in said frame section; and a divider positionable across said display area, each end of said divider being coupled to a corresponding clamp such that the divider extends across a portion of the display window for subdividing said display area.

2. The display frame of claim 1 wherein at least one of said fasteners couples a first end of said divider to said clamp.

3. The display frame of claim 2 wherein said first end has a slot formed therein for receiving a portion of said fastener.

4. The display frame of claim 1 wherein said fastener is a thumb screw.

5. The display frame of claim 1 wherein a portion of said divider has an H-shaped cross section.

6. The display frame of claim 1 wherein said divider has a length less than a length of at least one of said frame sections such that said divider may be stowed therein.

7. The display frame of claim 1 wherein each of said plurality of frame sections further comprises a spring mechanism interposed between said base member and said cover member to bias said cover member in an open position and closed position.

8. A divider and a display frame having a polygonal perimeter forming a display window that defines a display area, comprising:

a first clamp including a first slide block having a threaded aperture formed therein and a first fastener having a threaded shank received within said threaded aperture and a clamping face formed on an end of said threaded shank opposite said first block;

a second clamp including a second slide block having a threaded aperture formed therein and a second fastener having a threaded shank received within said threaded aperture and a clamping face formed on an end of said threaded shank opposite said second block; and a divider having a first end coupled to said threaded shank of said first fastener and a second end coupled to said threaded shank of said second fastener;

wherein said first and second clamps are releasably secured and slidably positionable within sections of the frame such that the divider extends across a portion of the display window for subdividing the display area.

9. The divider of claim 8 wherein each of said first and second slider blocks further comprises a retractable retainer mechanism.

10. The slider blocks of claim 8 wherein each of said first and second slider blocks further comprises a body having a blind bore formed therein, a pin slidably supported in said blind bore and a spring biasing said pin, wherein said pin is positionable from an extended position to a retracted position.

11. The divider of claim 8 wherein each of said said first and second slider blocks further comprise a body portion having a threaded aperture formed therein and a compliant lateral portion extending from said body portion, wherein said lateral portion is compressible from a relaxed position to a compressed position.

12. A display frame element suitable for forming a polygonal perimeter around a backing member to define a display area and securing a divider member to subdivide said display area, the frame element comprising:

a base member having means for securing a display area divider member to said base member;

a rotatable cover member hingedly attached to said base member;

a means for biasing said cover member in relation to said base member; and a display area divider positionable along said base member and securable to same at a plurality of angles ranging from a first position perpendicular to said base member to an alternate position parallel to said base member.

13. The display frame element of claim 12, wherein said means for securing a display area divider comprises a channel formed within said base member and a clamping member positioned within said channel.

14. The display frame element of claim 13, wherein said clamping member includes a block inserted and slidably positioned within said channel and a fastener threadingly engaging said block such that a flange formed on said base member and a first end of said divider is clamped therebetween for securing said clamp and said divider in a desired location in said frame element.

15. The display frame element of claim 14, wherein said first end of said divider has a slot formed therein for receiving a portion of said fastener.

16. The display frame element of claim 14 wherein said fastener is a thumb screw.

17. The display frame element of claim 12, wherein said means for biasing said cover in relation to said base is a spring mechanism interposed between said base member and said cover member to bias said cover member in an open position and closed position.

* * * * *